US005264020A

United States Patent [19]

Ehle et al.

[11] Patent Number: 5,264,020

[45] Date of Patent: Nov. 23, 1993

[54] SMELTING PLANT WITH TWO MELTING FURNACES ARRANGED IN JUXTAPOSED RELATIONSHIP

[75] Inventors: Joachim Ehle, Lautenbach; Gerhard Fuchs, Kehl-Bodersweier, both of Fed. Rep. of Germany

[73] Assignee: Fuchs Technology AG, Zug, Switzerland

[21] Appl. No.: 809,505

[22] PCT Filed: May 16, 1991

[86] PCT No.: PCT/EP91/00916

§ 371 Date: Mar. 16, 1992

§ 102(e) Date: Mar. 16, 1992

[87] PCT Pub. No.: WO91/18120

PCT Pub. Date: Nov. 28, 1991

[30] Foreign Application Priority Data

May 17, 1990 [DE] Fed. Rep. of Germany ..... 4015916

[51] Int. Cl.[5] ..... F27D 13/00

[52] U.S. Cl. ..... 75/10.38; 75/10.53; 266/142; 266/144; 266/168; 373/80

[58] Field of Search ..... 75/10.38, 10.53; 266/142, 144, 168; 373/80

[56] References Cited

U.S. PATENT DOCUMENTS

| | | | |
|---|---|---|---|
| 2,805,142 | 9/1957 | Arata | 75/10.38 |
| 2,805,929 | 9/1957 | Udy | 75/10.53 |
| 3,655,085 | 4/1972 | Aleck | 220/3 |
| 4,617,673 | 10/1986 | Fuchs et al. | 373/80 |

FOREIGN PATENT DOCUMENTS

| | | |
|---|---|---|
| 1433424 | 2/1969 | Fed. Rep. of Germany . |
| 1937839 | 2/1970 | Fed. Rep. of Germany . |
| 3232139 | 3/1984 | Fed. Rep. of Germany . |
| 8412739 | 1/1986 | Fed. Rep. of Germany . |
| 170809 | 2/1986 | Fed. Rep. of Germany . |
| 895534 | 5/1962 | United Kingdom . |

*Primary Examiner*—Peter D. Rosenberg

*Attorney, Agent, or Firm*—Oblon, Spivak, McClelland, Maier & Neustadt

[57] ABSTRACT

In a smelting plant including two melting furnaces which are arranged in juxtaposed relationship and which are operated alternately, wherein the furnace gases which are produced in the melting process are respectively introduced into the other melting furnace for the purposes of preheating the charging material, associated with each melting furnace is a shaft which is loaded with charging material, and the waste gases from the furnace which is in the melting mode of operation are introduced from the shaft, after charging of the other furnace, through the cover of the other furnace, and are removed from the shaft thereof. That procedure, throughout the entire smelting operation, permits preheating of charging material and filtration of the furnace gases when they are passed through the charging material.

21 Claims, 3 Drawing Sheets

SMELTING PLANT WITH TWO MELTING FURNACES ARRANGED IN JUXTAPOSED RELATIONSHIP

BACKGROUND OF THE INVENTION

1. Field of the Invention

The invention related to a smelting plant as set forth in the classifying portion of claim 1 and a method of operating such a smelting plant as set forth in the classifying portion of claim 18.

2. Discussion of the Background

A smelting plant of that kind is known for example from DE-A1 32 32 139. It includes two melting furnaces which are disposed in juxtaposed relationship and to which melting energy is supplied alternately by means of a heating arrangement in the form of arc electrodes. While the melting operation takes place in one melting furnace, the other furnace is tapped and re-charged and the waste gases from the furnace which is involved in the melting operation are passed through the other furnace, for preheating the fresh charge. That provides for more uniform utilization of the power supply and an increased level of productivity. In addition the heat content of the furnace waste gases which are produced in the melting and refining procedure is utilized for preheating the charge material of the respective other melting furnace and the fact that the waste gases are passed through the charge material means that the amount of dust produced and thus the loading applied to the dust removal arrangement which is at a downstream location are also reduced.

In order to assure that the gases flow with the maximum degree of uniformity through the material to be preheated and in order at the same time to prevent the gas conduit from becoming obstructed by charge material particles or spattered or splashed molten material, the furnace gases are taken off through the cover and introduced into the adjacent furnace vessel in the lower region of the casing thereof.

In the known smelting plant, the furnace waste gases cannot be used for preheating charge material in the initial phase of the melting procedure as in that phase the other melting furnace is being tapped, maintained and re-charged.

In addition the step of introducing the gases in the lower region of the wall of the vessel gives rise to problems because the opening which is required for that purpose is exposed to the effect of spattered or splashed molten material.

German utility model No 84 12 739 discloses a smelting plant with an arc furnace which includes a furnace vessel having a shaft-like charging material preheater which is arranged laterally on the furnace vessel and the interior of which, in a region adjoining its bottom, is communicated with the interior of the arc furnace through a connecting zone. In its upper region the charging material preheater has a closable charging arrangement for charging material and a gas outlet. A smelting plant of that kind permits the thermal energy of the furnace waste gases to be put to good use as long as the shaft-like charging material preheater is at least still partially filled. That advantage is lost at the end of the smelting phase and during the refining phase when the shaft-like charging material preheater is emptied, unless special steps are taken to ensure that charging material is also retained in the shaft-like charging material preheater, in that operating condition.

In a smelting plant of the kind set forth in the classifying portion of claim 1, the object of the invention is to permit preheating of metal charging material with the furnace gases of the furnace which is operating in the melting mode, and the coarse removal of dust from said furnace gases by charging material even during the initial phase of the melting procedure, in order to make better use of the heat content of the furnace waste gases and to reduce the total amount of dust involved. The invention seeks to make that possible without the opening for introducing the furnace gases of the other melting furnace having to be exposed to the effect of spattered or splashed molten material. The invention also aims to provide a method of operating such a smelting plant.

The smelting plant according to the invention is characterised by the features of claim 1. Advantageous configurations of that plant are set forth in claims 2 to 17. The method according to the invention is characterised by the features of claim 18. Advantageous configurations of the method are set forth in the other claims.

In the smelting plant according to the invention, the provision of a shaft which at one side replaces an outer segment of the furnace cover ensures, throughout the entire period of time that the heating device is switched on, that charging material is preheated with the hot furnace gases which are produced in the smelting and refining procedure, and the gases in that situation are filtered, either by the charging material in the shaft of the furnace in which the smelting operation is initiated, or by the charge material in the shaft of the other furnace when the column of charge material in the shaft in the first furnace has moved downwardly to such an extent that it can no longer perform that function. In that arrangement, the way in which the gas is passed can be suitably controlled by gas conduits which are adapted to be closed off. Preferably the gas inlet is arranged in the upper peripheral region of the vessel, in the vessel cover or in the lower region of the wall of the shaft of the melting furnace. As a result the gas is supplied at a location which is not exposed to the area of action of spattered or splashed molten metal or slag.

The invention is described in greater detail by means of an embodiment with reference to three diagrammatic Figures of drawings in which:

DESCRIPTION OF THE PREFERRED EMBODIMENTS

Figure 1:
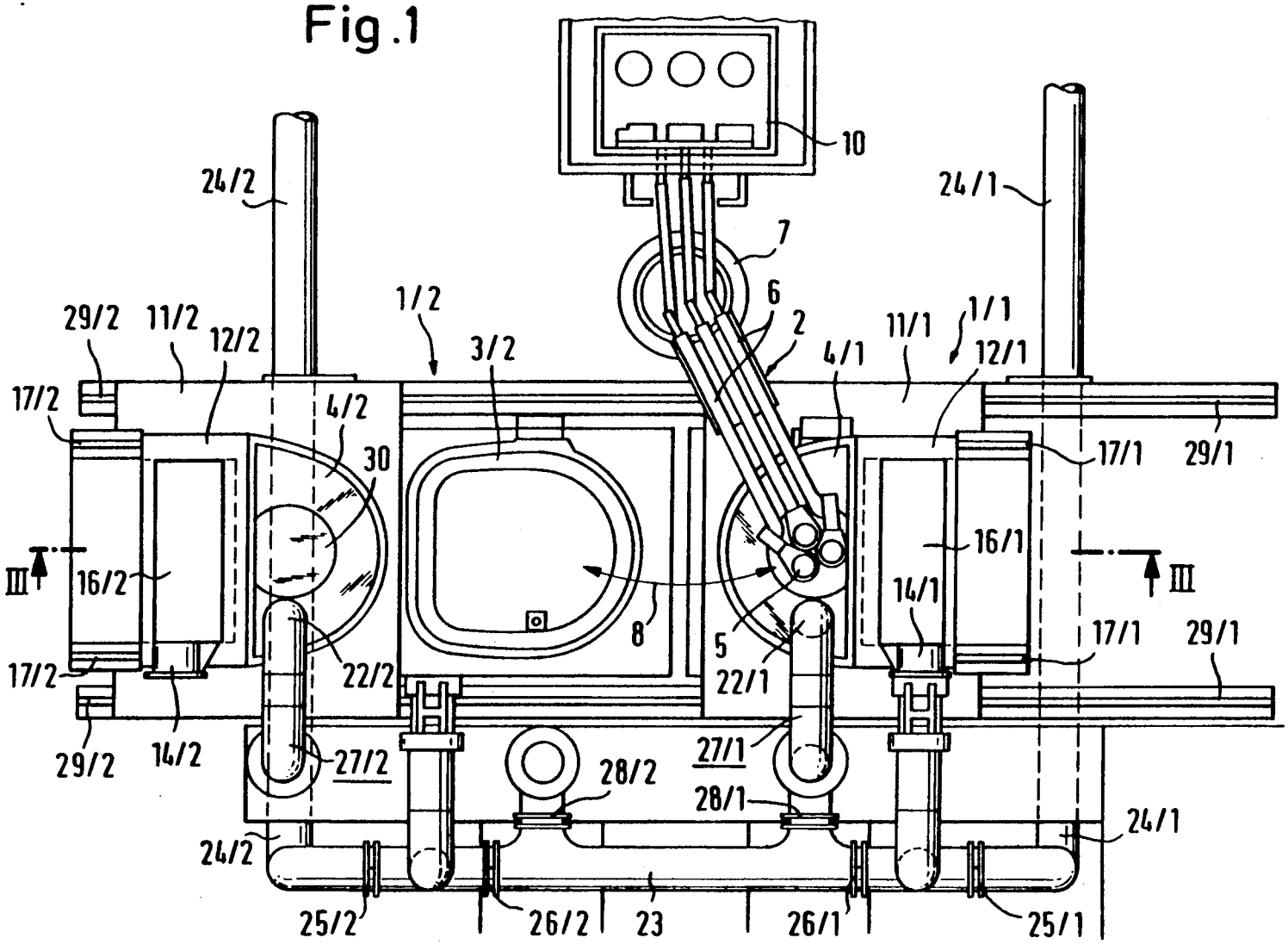
FIG. 1 is a plan view of a smelting plant according to this invention, with the furnace cover removed from the left-hand furnace vessel.

The smelting plant shown in the drawings includes two melting furnaces 1/1 and 1/2 which are arranged in juxtaposed relationship, and a heating device 2 by means of which heating energy can be selectively supplied to one of the furnaces 1/1 and 1/2 for heating the charging material such as steel scrap of the melting furnace in question, in order to melt it and raise it to a tapping temperature. Each melting furnace includes a furnace vessel 3/1 and 3/2 respectively, which can be closed by a vessel cover 4/1 and 4/2 respectively.

Figure 3:
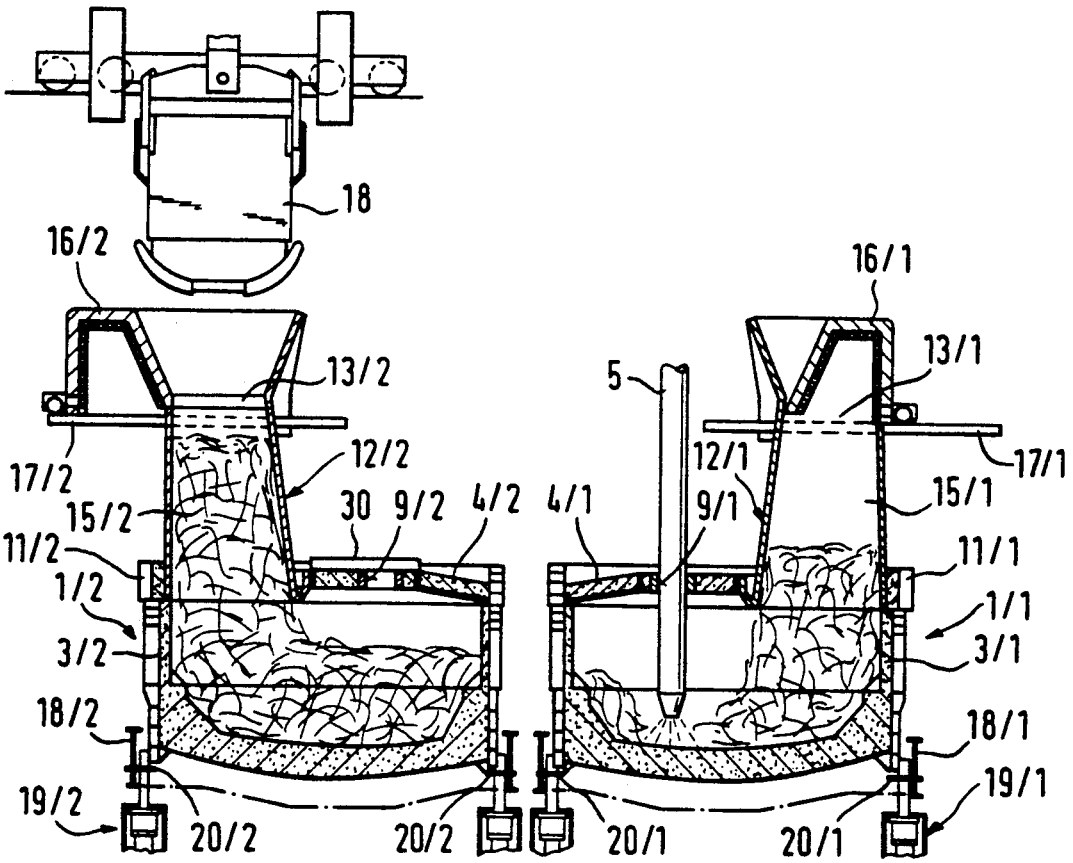
FIG. 3 shows a view in section taken along line III—III in FIG. 1 of part of the plant shown therein, with the vessel cover of the left-hand furnace vessel retracted into the closure position.

The heating device 2 is in the form of an electric arc device and includes three arc electrodes 5 which are each carried by a support arm 6. The support arms can be raised and lowered and, as shown in FIG. 1 by a double-headed arrow 8, pivoted laterally, by means of an electrode lifting and pivoting apparatus 7. They may be moved selectively into the first furnace vessel 3/1 or the second furnace vessel 3/2 through electrode passage openings 9/1 and 9/2 respectively provided in the respective vessel covers 4/1, 4/2. In plan view, the position of the electrode lifting and pivoting apparatus 7 is determined by the apex of an isosceles triangle, the base of which connects the centers between the respective three electrode passage openings 9/1 and 9/2 respectively. The electrodes are connected in the usual manner to the three phases of a transformer 10 which with the electrodes permits arc operation for introducing the heat required for the melting process. In each melting furnace 1/1 and 1/2, at one side and, more particularly, in the present case at the side remote from the adjacent furnace vessel, an outer segment of the vessel cover is replaced by a shaft 12/1 and 12/2 which is fixed in a holding structure 11/1 and 11/2 respectively. Each shaft is provided in its upper region with a closable opening 13/1, 13/2 for the charging material, and a gas outlet 14/1, 14/2. In plan view each of the shafts 12/1 and 12/2 is of an almost rectangular configuration, with a downwardly enlarging internal space 15/1 and 15/2. It can be closed by means of a shaft cover 16/1 and 16/2 which is of the cross-section illustrated in FIG. 3, in the form of an inverted U-shape, and it is horizontally displaceable on rails 17/1 and 17/2. FIG. 3 shows the shaft 12/1 in the closed condition and the shaft 12/2 in the opened condition in which charging material can be introduced into the shaft by means of a charging material container 18.

In plan view, the furnace vessels 3/1 and 3/2 are each in the form of an oval which is delineated by a straight line on one side (see the left-hand furnace vessel in FIG. 1), wherein the lower opening of the shaft opens into the region of the vessel which is defined by the straight wall portion and the adjacent portions of the oval. In addition, in the illustrated embodiment, the vessel cover 4/1, 4/2 is releasably secured to the holding structure 11/1 and 11/2 of the associated shaft 12/1 and 12/2 respectively.

Figure 2:
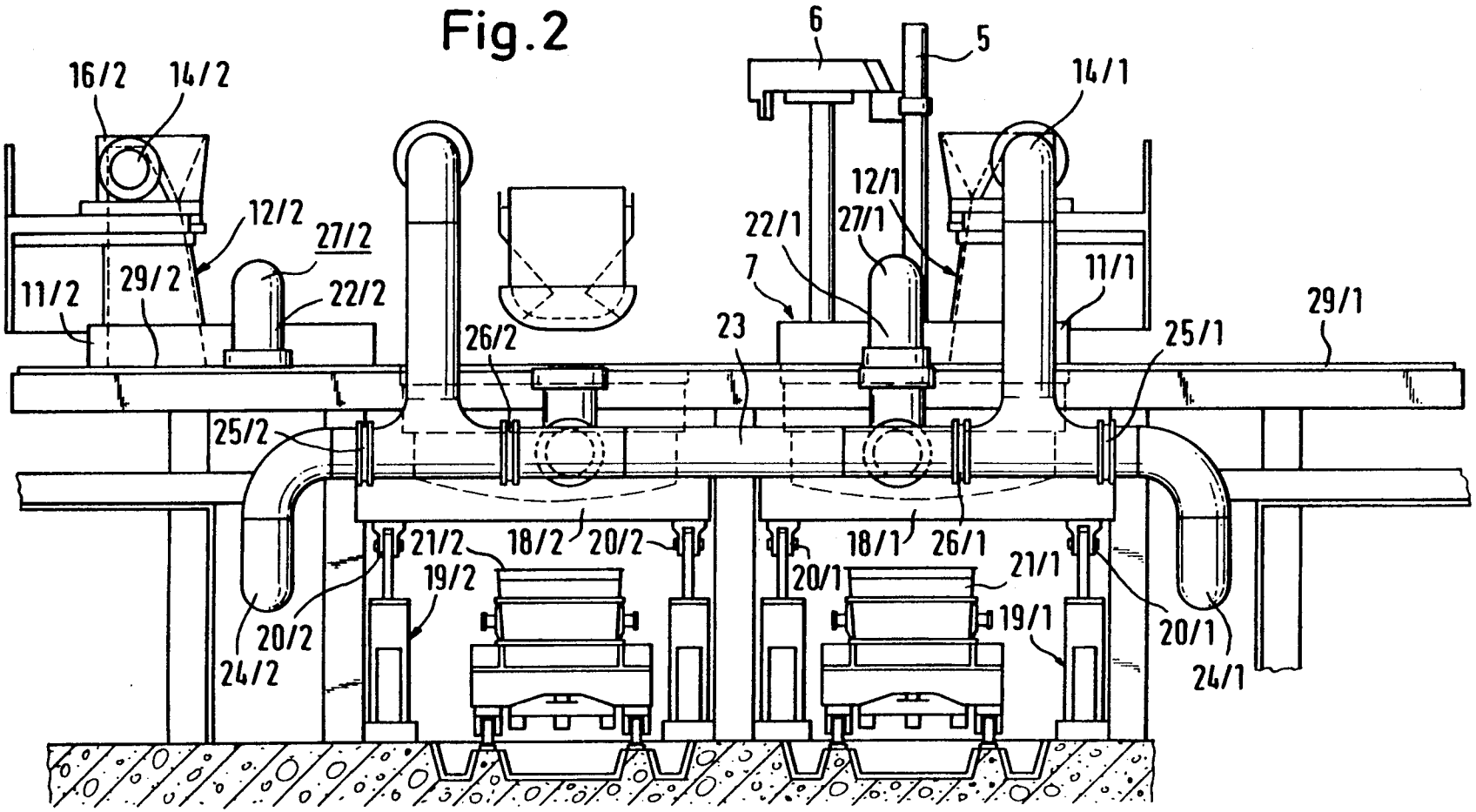
FIG. 2 is a side view of the FIG. 1 smelting plant.

The furnace vessels are secured in frames 18/1 and 18/2 respectively which in turn are mounted on lifting apparatuses 19/1 and 19/2 respectively. Each of the apparatuses 19/1, 19/2 includes four lifting or stroke-producing cylinders which engage the corners of the frame which is rectangular in plan view; the lifting cylinders are rotatably connected on one side to the frames 18/1, 18/2 by way of hinge connections 20/1 and 20/2 respectively. That design configuration permits both a lowering movement of the furnace vessels 3/1 and 3/2, and also a tilting movement for tapping the vessels through a tapping hole (not shown) in the bottom of the respective vessel. In the view shown in FIGS. 2 and 3, the tilting movement takes place perpendicularly to the plane of the paper. Shown beneath the furnace vessels in FIG. 2 are ladles 21/1 and 21/2, for receiving the liquid metal from the furnace vessels. The electrode passage openings in the melting furnaces can be closed by a cover plate 30 when the electrodes are removed (see FIG. 3).

In order to be able to utilize the hot furnace gases which are produced in the melting process and when the molten metal is superheated to the tapping temperature, for the purposes of preheating charging material, and at the same time to reduce the loading on the dust removal arrangement, the plant includes a gas conduit system which is described hereinafter.

Each of the gas outlets 14/1 and 14/2 respectively can be selectively communicated by gas conduits which can be closed off, either to a waste gas chimney by way of a filter device or to a gas inlet 22/2, 22/1 in the cover 4/2 or 4/1 of the adjacent melting furnace 1/2 and 1/1 respectively. The gas conduit system of the illustrated embodiment will now be described in greater detail with reference to FIG. 1 and 2.

A gas conduit 23, the ends of which are connected to communicating conduits 24/1 and 24/2 going to the dust removal arrangement, is divided by shut-off members 25/1, 26/1, 26/2 and 25/2 into two outer gas conduit portions and a central gas conduit portion. The shut-off members may be for example in the form of sliders or pivoting flaps which can be actuated by control members. The two outer gas conduit portions are connected by way of branch conduits to the gas outlets 14/1 and 14/2 of the shafts 12/1 and 12/2, while the central portion is connected by way of branch conduits and bends 27/1 and 27/2 to the gas inlet 22/1, 22/2 in the vessel cover of the first and second melting furnaces respectively. The last-mentioned branch conduit portions include further shut-off members 28/1 and 28/2.

In the illustrated embodiment the holding structure 11/1, 11/2 of each shaft, including the cover carried thereby, is displaceable parallel to the connecting line extending between the center lines of the shafts, on rails 29/1 and 29/2. FIG. 1 shows the vessel cover 4/2 in the position in which it is moved to the side and in which the furnace vessel is opened for charging of the contents of a charging material container directly into the furnace vessel. Before the cover with the holding structure is moved, the respective furnace vessel must be lowered slightly by means of the lifting apparatuses 19/1 and 19/2.

As can be seen from FIGS. 1 and 2, the bend 27/2 is fixedly connected to the gas inlet 22/2 and is moved together with the holding structure 11/2. The same applies in regard to the bend 27/1 of the other vessel. The bends must therefore be releasably connected to the associated branch portions of the gas conduit 23. The same applies to the branch portions of the outer sections of the gas conduit 23, in relation to the gas outlet openings 14/1 and 14/2 of the shafts 12/1 and 12/2.

Accessibility to the upper opening of the furnace vessel for directly charging charging material into that vessel could also be ensured, if the covers are stationary, if the furnace vessels are movable perpendicularly to the connecting line joining the center lines of the shafts. That modification is not shown.

A preferred method using the above-described smelting plant will now be described.

For the purposes of charging the melting furnace 1/1, the electrodes 5 are raised and pivoted laterally away. At the same time the furnace vessel is lowered somewhat by means of the lifting apparatus 19/1. Thereupon, the holding structure 11/1 is moved on the rails 29/1 towards the side, that is to say it is moved towards the right from the position shown in FIGS. 1 and 2 so that the opening of the vessel 3/1 is open for the charging operation. After the content of a first basket has been loaded directly into the vessel, the cover with the shaft is moved by means of the holding apparatus thereof into the operative position again and the furnace vessel is raised by means of the lifting apparatus 19/1 until the edge of the vessel is tightly sealed to the cover.

Now, with the shaft cover 16/1 in a position in which it is moved to the side, two or three further baskets are loaded by way of the shaft 12/1 until the shaft is filled. The volume of the charging material corresponds to that of an entire molten bath. The shut-off members in the gas conduit 23 are actuated in such a way that the gas outlet 14/1 of the shaft 12/1 is connected to the connecting conduit 24/1, that is to say the shut-off members 26/1 and 28/1 must be closed and the shut-off member 25/1 must be opened. After the electrodes 5 have been moved into the operative position for the melting furnace 1/1 by the electrode lifting and pivoting apparatus 7 and the arcs have been fired, the smelting process in that furnace is initiated. Instead of or in addition to the arc electrodes, burners may also be provided as the heating apparatus (not shown).

While the first phase of the smelting procedure is taking place in the melting furnace 1/1 and the furnace gases which are produced in that phase are being passed through the shaft 12/1 of that melting furnace and then to the dust removal apparatus, the second furnace vessel 3/2 can be charged in the same manner as the first furnace vessel was charged previously. After the operation of charging that vessel, when there is a second heating apparatus, for example burners, and with the shut-off members 28/2 and 26/2 in the closed position and the shut-off member 25/2 in the open position, it is already possible to begin the operation of heating that charge.

As long as the waste gases in the first melting furnace 1/1 are sufficiently cooled down by the charging material in the shaft 12/1, those waste gases are passed by way of a fan directly to the filter installation, that is to say the dust removal apparatus. When the rising temperatures of the waste gases from the shaft have reached a sufficiently high value and the other melting furnace is charged and the charge thereof is possibly preheated by the second heating apparatus, the waste gas is then circulated into the vessel of the second melting furnace 1/2 and passed through the shaft 12/2 of that melting furnace. For that purpose the shut-off members 25/1, 28/2 and 26/2 must be closed and the shut-off members 26/1, 28/2 and 25/2 must be opened. That provides that the gas is passed from the upper end of the shaft of the first melting furnace 1/1 into the second adjacent melting furnace 1/2 through the cover thereof, and is passed from there through the shaft 12/2 of that melting furnace and is drawn off, from the upper gas outlet 14/2, into the filter installation. Thus the energy of the waste gas is put to very good use, throughout the entire melting and refining process in the first melting furnace 1/1. At the same time the particles of dust which are contained in the gas are deposited in the charging material in the shaft 12/2 of the second melting furnace.

When the molten material in the first melting furnace 1/1 is ready to be tapped and the appropriate carbon has been adjusted, the electrodes 5 are raised and immediately pivot to the second melting furnace 1/2 so that there they can immediately begin the melting procedure after the shut-off members have been changed over, in a similar manner to the procedure described above in relation to the melting furnace 1/2. At the beginning of the melting procedure in the second melting furnace 1/2, the shut-off members 26/2 and 28/2 must be closed and the shut-off member 25/2 must be opened. The first melting furnace 1/1 can now be tapped by actuating the lifting apparatus 19/1 at one side. The tapping hole is then checked and filled and immediately thereafter the whole amount of the charging material for the next molten bath is introduced into the furnace vessel or into the shaft. Here too, when the installation has a second heating apparatus, it is possible to begin the operation of preheating that charge, with the shut-off members 28/1 and 26/1 in the closed condition and the shutoff member 25/1 in the open condition. In the second phase of the melting procedure in the shaft furnace 1/2 the shut-off members 25/2, 28/2 and 26/1 must be closed and the shut-off members 26/2, 28/1 and 25/1 must be opened.

Very good utilization of the waste gases and filtration of the waste gases is achieved by virtue of the fact that the furnace gases are firstly passed through the shaft of their own melting furnace while the other melting furnace is being tapped and charged, and, when the temperature of the waste gas of the first shaft has risen sufficiently or the column of scrap has moved downwardly almost as far as the level of the vessel cover, as a result of the smelting procedure, the furnace gases are passed into the other vessel and from there through the filled scrap shaft. The flow of gases can be diverted in a simple fashion by virtue of control of the shut-off members.

Immediately after the charging material has been melted in the one melting furnace and raised to its tapping temperature, the electrodes are pivoted to the other melting furnace and there begin the smelting procedure, and it is possible to achieve a tap-to-tap time of about 35 minutes with the above-described smelting plant, for example when the heating apparatus has a switch-on time of 32 minutes per melting furnace plus 2 minutes for sampling and 1 minute for pivoting the electrodes.

The operations of tapping the furnace vessel and subsequently filling the tapping hole and the charging operations last for a total of about 15 minutes so that there is still a further period of 20 minutes remaining, for the step of preheating the charging material in the respective other melting furnace. That period is adequate for making good use of the waste gases. A consideration of particular significance in that respect is the reduction in the total amount of dust produced, by virtue of the furnace gases being filtered as they are passed through the charging material. The dust is deposited in the charging material and very substantially melted with the slag and removed.

In the described embodiment the gas conduits which lead from the gas outlet of the shaft of the one melting furnace to the gas inlet in the cover of the other melting furnace have branch portions going to the dust removal apparatus. Instead of those branch portions, the arrangement may also comprise, in the upper region of each shaft, a second gas outlet which is communicated with the dust removal apparatus by way of a gas conduit which is adapted to be closed off. There is also no need for the gas inlet to be provided in the cover. It may also be disposed in the lower region of the shaft or in the upper peripheral region of the vessel of the melting furnace 1/1 or 1/2 respectively.

In the described embodiment, separation of the vessel cover from the upper edge of the vessel, as is required for transverse displacement of the vessel cover, is produced by downward movement of the furnace vessel by means of the lifting apparatus, which at the same time permits a tilting movement of the vessel for tapping purposes. However the necessary separation of the vessel cover from the edge of the vessel may also be produced by a lifting movement of the holding structure in which the vessel cover is releasably secured.

In the described embodiment, the operation of charging the second and third scrap baskets into the upper shaft opening forms a column of charging material, which is supported on the bottom of the vessel and which fills the shaft. In the smelting operation, material is melted away from the lower region of the column of charging material so that the height of that column is progressively reduced. Another possible alternative provides that disposed in the lower region of the shaft, which replaces a part of the vessel cover, is a movable blocking member which is movable from a closed position in which it forms a support for charging material, into a release position for material to be charged into the furnace vessel. By virtue of that arrangement, at the beginning of the smelting procedure, the column of charging material may be retained in the shaft of the respective furnace, without a reduction in the height of the column, until the column is released by the movable blocking member so that it can pass into the furnace vessel. That increases the possible variations in the operating procedure.

A suitable heating arrangement is not only arc electrodes which are supplied from a power source but also burners, on an inductive heating arrangement and the like. If, as in the above-described construction, the plant uses arc electrodes which are introduced through electrode openings in the cover, then the electrode passage openings must be closed in the vessel through which are passed the furnace gases which are generated in operation of the other melting furnace, with the electrode openings being closed either by means of individual covers for each opening or by a common cover for all the electrode openings.

What is claimed as new and desired to be secured by Letters Patent of the United States is:

1. A smelting plant, comprising:

a heating apparatus for the supply of melting energy and two melting furnaces arranged in juxtaposed relationship and each comprising a furnace vessel including a vessel cover for closing the vessel each vessel having a gas inlet, a gas outlet, gas conduits which are adapted to be shut off and which respectively communicate the gas inlet of the one melting furnace with the gas outlet of the other melting furnace, respectively, so that, for the purposes of preheating metallic charging material, the furnace gases produced in the melting process in the one melting furnace are passed into the respective other melting furnace, wherein in each melting furnace, a shaft is provided which is fixed in a holding structure and which in an upper region thereof has a closable loading opening for the charging material and the gas outlet of the respective melting furnace.

2. A smelting plant as set forth in claim 1 wherein the gas inlet is disposed in one of the upper peripheral region of the furnace vessel, the vessel cover and the lower region of the wall of the shaft of the respective melting furnace.

3. A smelting plant as set forth in claim 1 wherein at least one of the two gas conduits has a branch portion which leads to a dust removal apparatus by way of a further gas conduit which is adapted to be selectively shut off.

4. A smelting plant as set forth in claim 1 which comprises a further gas outlet provided in the upper region of the shaft of at least one of the two melting furnaces, a dust removal apparatus, and a further gas conduit for connecting said further gas outlet to said dust removal apparatus wherein said further gas conduit includes a shut off device.

5. A smelting plant as set forth in claim 1 wherein the shaft is disposed at a position which is remote from the adjacent vessel.

6. A smelting plant as set forth in claim 1 wherein the shaft is of a substantially rectangular configuration in plan view.

7. A smelting plant as set forth in claim 1 wherein the cross-section of the interior of the shaft is enlarged in a downward direction.

8. A smelting plant as set forth in claim 1 wherein in plan view the furnace vessels are each in the form of an oval which is delineated on one side by a straight line, and the lower opening of the shaft opens into the region of the vessel which is defined by a straight wall portion and adjacent portions of the oval.

9. A smelting plant as set forth in claim 8 characterised in that the straight line defines the oval over between three quarters and nine tenths of its length.

10. A smelting plant as set forth in claim 1 wherein the vessel cover is releasably secured to the holding structure.

11. A smelting plant as set forth in claim 1 which comprises means for lifting the holding structure can be relative to the furnace vessel.

12. A smelting plant as set forth in claim 1 which comprises means for lowering the furnace vessel relative to the holding structure.

13. A smelting plant as set forth in claim 1 which comprises means for moving the holding structure and the furnace vessel horizontally relative to each other.

14. A smelting plant as set forth in claim 13 which comprises means for displacing the holding structure parallel to a connecting line between center lines of the shafts.

15. A smelting plant as set forth in claim 13 which comprises means for moving the furnace vessels perpendicularly to a connecting line between the center lines of the shafts.

16. A smelting plant as set forth in claim 1 which comprises at least one movable blocking member located in the lower region of the shaft in such a way as to be movable from a closure position in which said blocking member forms a support for charging material, into one of a release and an open position for the operation of charging material into the furnace vessel so as to open the way for charging material to pass through the shaft.

17. A smelting plant as set forth in claim 1 wherein the vessel covers of the two melting furnaces each have at least one closable electrode opening and wherein an electrode lifting and pivoting apparatus is arranged beside the furnace vessels for introducing one or more arc electrodes selectively into one of the melting furnaces.

18. A method of preheating and smelting metallic charge material by means of a heating apparatus in a smelting plant which comprises:

a) charging a charging material into a first vessel and a first shaft associated with said vessel, until said first shaft is at least partially filled, b) heating the charging material in the first vessel by the heating apparatus and carrying furnace gases out of the first shaft into a waste gas chimney;

c) repeating step a) in a second melting furnace;

d) diverting the furnace gases from the first vessel, which are removed from the first shaft, into a second vessel and through a second shaft to a waste gas chimney;

e) smelting of the charging material and metallurgical treating of the molten material in the first vessel, and subsequently heating the charging material in the second vessel by the heating apparatus and tapping and performing maintenance of the first vessel; and f) repeating steps a) to e).

19. A method as set forth in claim 18 which comprises, in the operation of charging the charging material, introducing a part of the charging material directly into the vessel, with the vessel cover removed, and introducing the remainder of the charging material into the shaft associated with the vessel.

20. A method as set forth in claim 18 which comprises effecting the operation of heating the charging material by one of an arc and a burner.

21. A method as set forth in claim 18 which comprises retaining the charging material in the shaft of the melting furnace in which the melting procedure is just taking place, until the furnace gases of said melting furnace are diverted into the other melting furnace.

* * * * *